United States Patent [19]

Deutsch et al.

[11] 3,968,609

[45] July 13, 1976

[54] ASSEMBLY FOR FORMING A STRUCTURE HAVING GENERALLY CURVED SURFACES

[75] Inventors: Ernst Deutsch; Bernhard Reifenscheid, both of Marl, Germany

[73] Assignee: Chemische Werke Huls Aktiengesellschaft, Germany

[22] Filed: Apr. 1, 1974

[21] Appl. No.: 457,214

[30] Foreign Application Priority Data

Mar. 31, 1973 Germany ..... 2316175

[52] U.S. Cl. ..... 52/245; 52/81; 52/400; 52/488; 52/677

[51] Int. Cl.[2] ..... E04B 7/14

[58] Field of Search ..... 52/80, 81, 71, 459, 52/677, 460, 584, 400, 395, 461, 463, 467, 488, 245

[56] References Cited

UNITED STATES PATENTS

| | | | |
|---|---|---|---|
| 1,227,861 | 5/1917 | Waugh | 52/395 |
| 2,203,174 | 6/1940 | Muttray | 52/81 |
| 2,293,569 | 8/1942 | Sonino | 52/71 |
| 3,158,961 | 12/1964 | Hawkins | 52/71 |
| 3,192,669 | 7/1965 | Hawkins | 52/81 |

*Primary Examiner*—John E. Murtagh
*Attorney, Agent, or Firm*—Craig & Antonelli

[57] ABSTRACT

An assembly for lining or sheathing a network or framework such as a cable network to form a structure defining generally curved surfaces comprises at least one connector panel including two associated clamping plates and a filling plate therebetween for clamping and holding the covering panels employed to line the framework. The connector panels are attached to the framework by means of firm or elastic intermediate elements and are made from a material which is both weather-resistant and age-resistant.

17 Claims, 24 Drawing Figures

FIG. 2
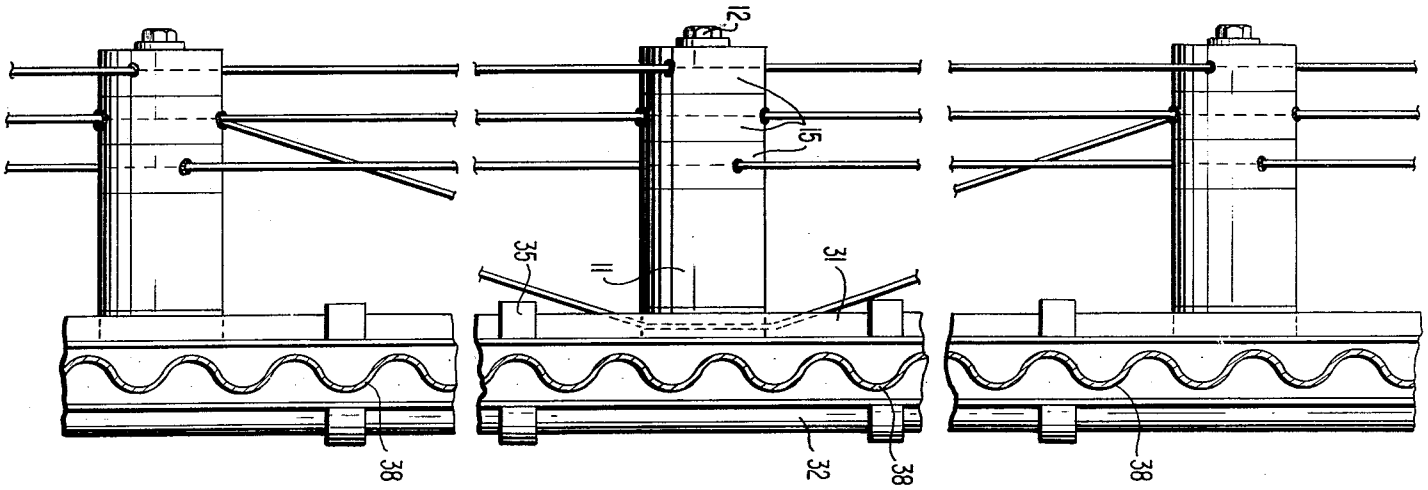
FIG. 3A
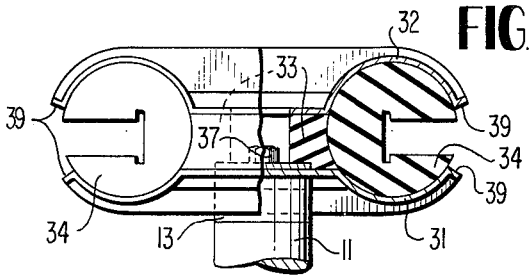
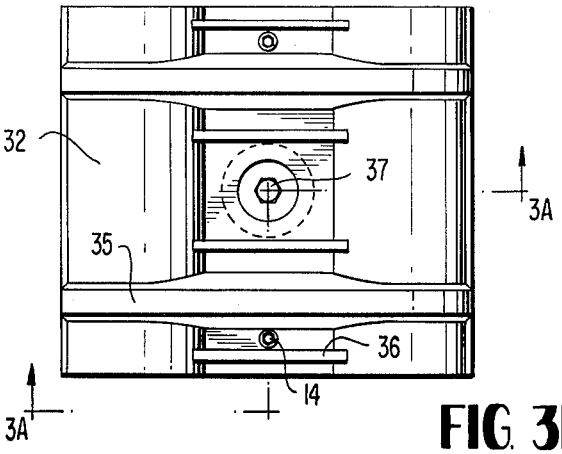
FIG. 3B
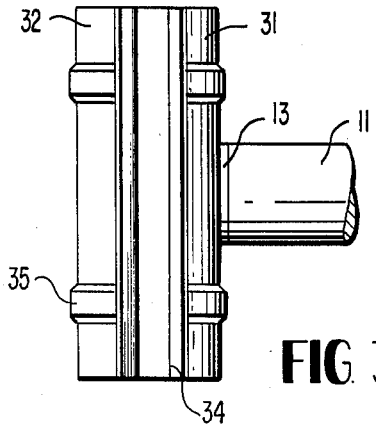
FIG. 3C
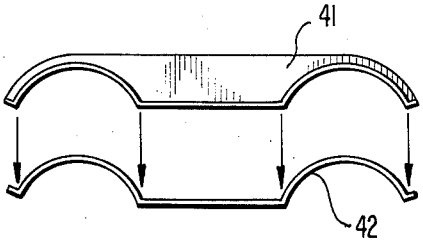
FIG. 4

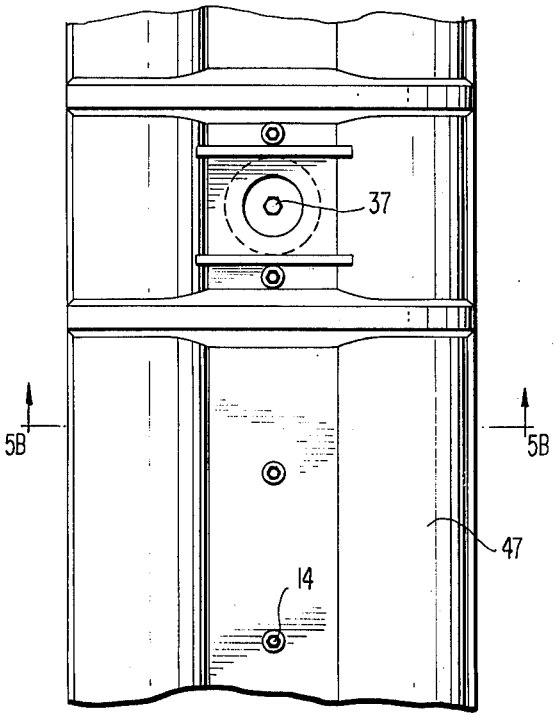
FIG. 5A
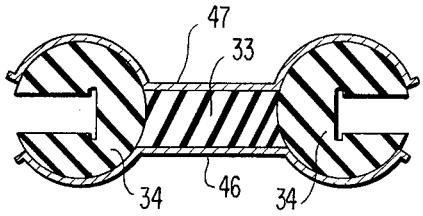
FIG. 5B
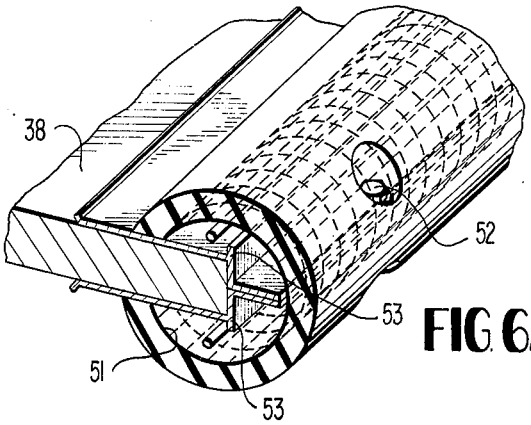
FIG. 6A
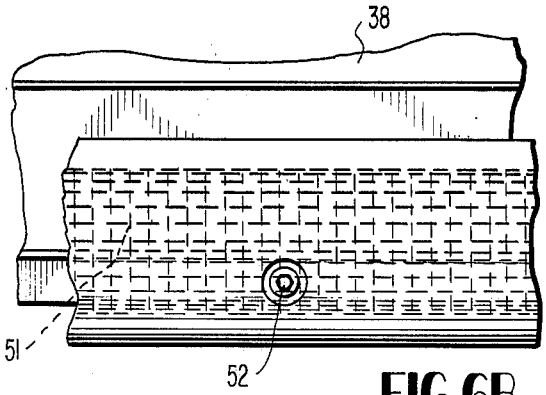
FIG. 6B
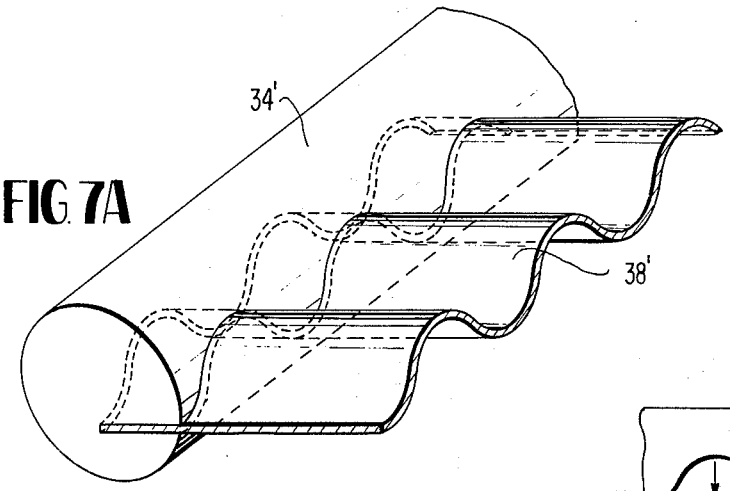
FIG. 7A
FIG. 7B
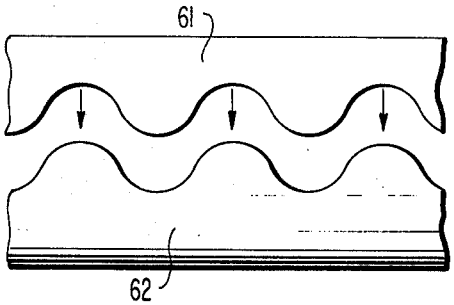

ASSEMBLY FOR FORMING A STRUCTURE HAVING GENERALLY CURVED SURFACES

BACKGROUND OF THE INVENTION

This invention relates to an assembly for sheathing or forming generally curved surfaces with polymeric or metallic materials.

Generally the term curved surfaces as used within the scope of the present invention is understood to mean surfaces of revolution, cylindrical surfaces, translation surfaces and prismatic surfaces formed by structural members.

More particularly, such generally curved surfaces can be produced or formed, on the one hand, by generally curved shell sections, such as, for example, concrete shells, thin sheets of fabric, curved deep-drawn sheet metal, pneumatic constructions, and, on the other hand, by a structure including polygonal arrangement of supporting elements, such as, for example, rods, wire ropes, cables, beams, trusses and purlins.

In the manufacture of generally curved surfaces of, for example, concrete or sheet-metal shells, the structural element or member carries the local or sectional forces, e.g. bending stresses, transverse forces, normal forces, torsional forces, etc. In addition, such structural elements, frequently in conjunction with additional sheathings or linings often serve to protect the space defined, for example, in the interior of the structure from weather and atmospheric influences.

If surfaces defining a generally three-dimensionally curved configuration are erected with the aid of a polygonal arrangement of supporting elements, a lining or sheathing is normally required which is conformed to the openings or interstices provided by this arrangement. This sheathing, in the form for example of a skin having the same shape as the openings in the frame can be arranged in all practicable planes of the polygonal joints, that is in all planes which are formed by using those polygonal joints which are necessary to mount the sheathing on.

Thus, for example, a roof arrangement with a roof skin or lining serving as the sheathing has been employed as the roof of the Olympia Stadium in Munich. In this connection, an extensively orthogonal cable network was utilized as the supporting construction or elements for the roof, *The German Architect*, a publication of the German Architects' Association, vol. 8/72, pp. 569–583.

A roof arrangement in which the roof skin is placed on the underside is known, for example, from the tent roof of the German Pavilion at the 1967 World's Fair in Montreal. Here again, the supporting structure is a cable network, *Plastics*, vol. 1/73, pp. 21–23.

Also, the pavilion of the "Aluminum Center" for the Hannover Fair, constructed as a hyperbolic paraboloid, has a sheathing covering a generally curved surface on its underside, *Central Issue for Industrial Construction*, vol. 5/72, pp. 178–181.

In the manufacture of a generally curved surface employing a frame of bending girders, lattice girders, rafters or purlins, for example, the network or framework produced by assembling the girders, etc. are covered, for instance, by panels of concrete, wood, synthetic resins, metal, asbestos cement, or glass. The cover panels are normally resting directly on the chords of the above-mentioned girders disposed between the nodal points or joints, which chords are especially dimensioned against intermediate bending stresses and are sufficiently rigid. In other words, the cover panels are normally resting directly on the portions of the above-mentioned girders extending between joints or points of intersection of the girders. Moreover, the girder portions extending between the joints are sufficiently rigid and especially dimensioned so as to resist bending stresses.

Finally, chords, tie rods, laths or profile members, for example, of steel, metal, wood or synthetic resin, for example, are arranged crosswise on a supporting structure or frameword, for example for the manufacture of rear-ventilated facades. The thus-produced framework or network is lined with the materials customary in the building industry by attaching thereto panels generally having the configuration of the openings in the framework by means of nails, screws, clamping means and the like.

However, as is known, covering of a generally curved surface presents difficulties if the load-bearing portion of the structure, i.e. the structural member is present, for example, in the form of a shell. Such difficulties are also encountered in structures employing a frame having a polygonal arrangement of support elements if the elements forming the mesh-like frame are not parallel to one another, as for example when they are arranged in a mutually skewed arrangement or when they enclose or define twisted and/or torsionally distorted curved areas. Such configurations are produced, for example, in a rope system by the intersecting generatrices of a hyperboloid of revolution. In this system pretensioned meridian ropes, to obtain a pretensioning and a curvature in the generatrices, can be additionally extended through the rope clamps disposed in the points of intersection of the generatrices. The openings or interstices formed by the intersecting generatrices are generally different either with respect to their dimensions which depend on the position in the rope network, or because the generatrices are not parallel to one another. Additional difficulties are encountered in this type of rope network construction, on the one hand, because no right angles are produced by the intersecting generatrices and, on the other hand, because the generatrices which lie side-by-side are askew with respect to one another and in addition have distortions caused by pretensioned meridian ropes.

For the reasons set out above, the covering of such generally curved surface areas has been possible heretofore only at great financial and technical expenditure. It is, therefore, an object of the present invention to provide improved covering or sheathing systems for producing structures having curved surfaces.

In addition, it is a further object of the present invention to provide a system by means of which generally three-dimensional surface areas can be lined or covered in a simple and economical manner.

SUMMARY OF THE INVENTION

These and other objects are attained, according to the present invention, by providing a sheathing assembly for sheathing a support means which includes:

a. a connector means adapted to be joined to the support means via an intermediate mounting means, said connector means having two clamping means and a filling means therebetween to regulate the distance between the individual clamping means, and b. covering means elastically retained by the connector means, and shaped to cover the support means.

More particularly, the present invention provides an assembly for sheathing a network thereby forming a structure having generally curved surfaces comprising: a connector panel or strip adapted to be joined to the network via a rigid or elastic intermediate element, the connector panel or strip comprising at least two associated clamping plates and a filling panel therebetween to regulate the distance between the individual clamping plates or strips, the connector panel or strip holding two bearing profile members made from a weather-resistant and aging-resistant vulcanized elastomer, the assembly further including a covering panel attached to at least one of the bearing profile members held by the connector panel or strip, the covering panel being shaped to fit the network.

BRIEF DESCRIPTION OF THE DRAWINGS

The present invention may be more readily understood by reference to following drawings wherein:

FIG. 2 is a side view of a system such as illustrated in FIG. 1, but employing corrugated covering panels in place of the covering panels employed in the assembly of FIG. 1;

FIGS. 3A, 3B and 3C are elevational, plan and side views, respectively, of a connector panel employed in the system illustrated in FIG. 1, FIG. 3A being viewed from line 3A—3A in FIG. 3B;

FIG. 4 is an elevational view of a composite clamping plate employed in the connector panel illustrated in FIGS. 3A, 3B and 3C;

FIGS. 5A and 5B are top and cross-sectional views, respectively, of connector strips which can be used in place of the connector panels of FIGS. 3A, 3B and 3C in the assembly of FIG. 1, FIG. 5B being viewed from line 5B—5B in FIG. 5A;

FIGS. 6A and 6B are perspective and top views, respectively, of the bearing profile members secured to the edges of the covering panels employed as the linings or sheathings in the assembly of FIG. 1;

FIGS. 7A and 7B illustrate a modified bearing profile member made from two pieces and adapted to be secured to a corrugated covering panel;

DETAILED DESCRIPTION

The system according to the present invention is basically suitable for forming the covering or lining in structures defining all types of generally curved surfaces. However, the system is preferably employed in the sheathing or covering of load-carrying constructions made up of a network of cables, ropes or like strand-like members.

Figure 10A:
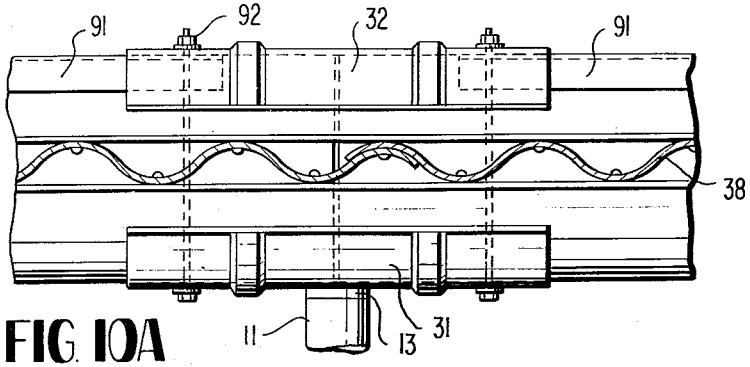
FIGS. 10A and 10B are elevational and top views, respectively, illustrating the employment of additional sealing plates to cover the opening between adjacent covering panels when the assembly of FIG. 1 employs connector plates to hold various covering panels in place.
Figure 10B:
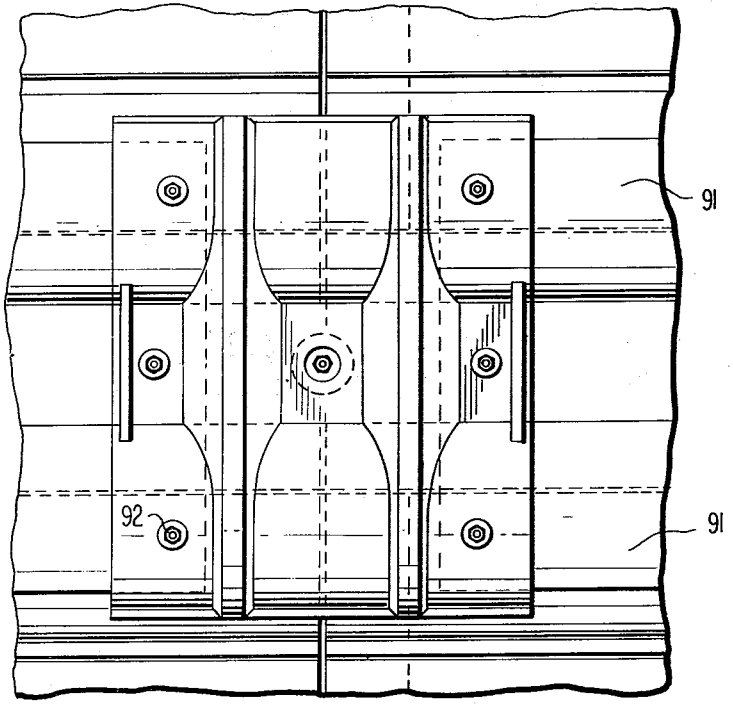

In general, when covering a load-supporting network construction with the system of this invention, the assembly procedure followed is such that first the mounting means shown as a rigid or elastic intermediate element 11 (FIGS. 1 and 2) is attached to an attaching means shown as cable clamp 15 attached to the crossed ropes 16. Thereafter, spacer means such as spacer rings 13, as well as the lower clamping means, clamping plate 31 (FIG. 3A) and/or clamping strip 46 (FIGS. 5A and 5B) are mounted on this intermediate element, and the components are appropriately aligned. The next step is the insertion of the filling means, the filling panel 33 (FIGS. 3A and 5B), and the elastic bearing means shown as bearing profile members 34, which preferably already engage the covering means, covering panels 38. Subsequently, the upper clamping means, clamping plate 32 (FIG. 3A) and/or clamping strip 47 (FIGS. 5A and 5B), is placed thereon and affixed thereto, whereby the bearing profile members are held by the retaining means formed by the cylindrical spaces between the upper and lower clamping plates 31 and 32. Finally, especially when using clamping plates, sealing means, shown in the form of sealing panels 91 (FIGS. 10A and 10B), are additionally mounted, which serve for covering certain edges of the covering panels.

Because of the clearance available to the individual covering panels with the surrounding bearing profile member between the upper and lower clamping plates and/or between the clamping strips of the connector panel, a sufficient adaptation to the generally curved surface to be lined is made possible.

Figure 1:
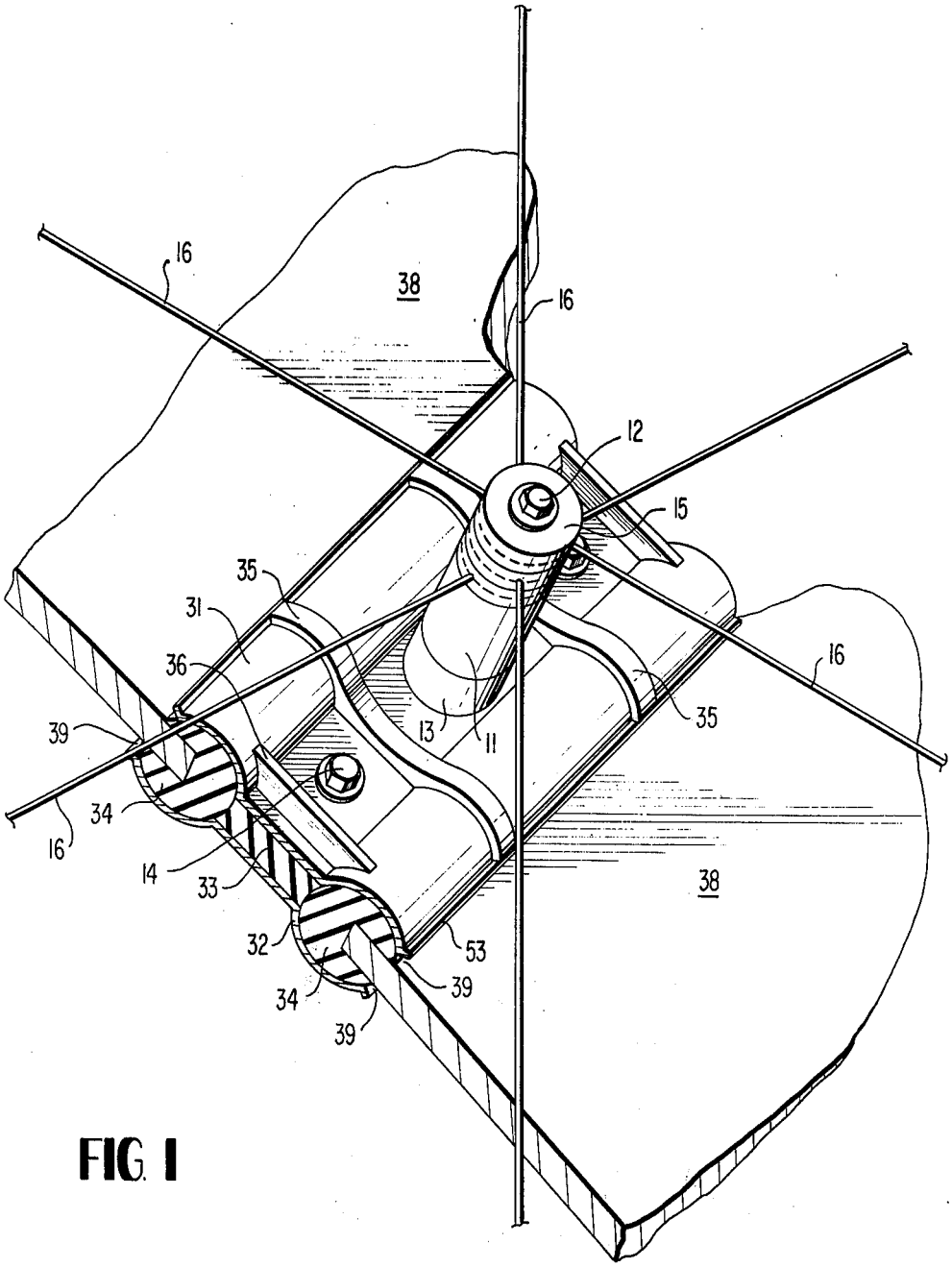
FIG. 1 is a perspective view of an assembly according to the present invention employed to sheath a rope network with a suitable lining or covering, on the outer or upper portion thereof.

More particularly, as shown in FIGS. 1 and 3A, a suitable clearance is maintained between the surfaces of the covering panels 38 and the outer lateral edges of clamping plates 31 and 32. With this construction, the bearing profile members 34 are adapted to rotate within the cylindrical spaces between the clamping plates through suitable arcs, thereby enabling the assembly to readily adapt itself to the shape of the network to be lined.

The position of the firm or elastic intermediate element 11 and the possible spacer rings 13 at the cable clamp of the crossed cables 16 can be seen from FIG. 1. The mounting with the cable clamp 15 is effected by means of a clamping screw 12. In general, the intermediate element 11 is cylindrical, the geometric dimensions of which are dependent on the forces to be absorbed.

The use of elastic intermediate elements, on the one hand, and the firm elements, on the other hand, is required due to the dual function of the intermediate element. Thus, it is the task of the elastic intermediate element to absorb, without squeezing or pinching, any possible displacements which can be caused, for example, by thermal expansion of the covering, while the firm intermediate element is to prevent the covering from sliding off. A firm or rigid intermediate element is, for this reason, always additionally joined to adjacent cable clamps by a fixed mounting. The term "fixed mounting" refers to FIG. 2 where as a possible example a rope connects three or more adjacent nodal joints to secure a fixed mounting or "non-displaceable connection" (see below, page 12, lines 6 to 9). In general, in a covered load-bearing cable network construction, the firm intermediate elements are less in number than the elastic intermediate elements.

A suitable material for the elastic intermediate element is basically any vulcanized rubber of sufficient strength, and in the illustrated embodiment the elastic intermediate elements are made from BUNA AP rubber made by BUNA WERKE HUELS GMBH. Of course, those rubber types are preferably employed which are particularly stable with respect to weathering and aging, such as for example, butyl rubber, polychloroprene and unsaturated ethylenepropylene rubber (e.g. BUNA AP rubber made by BUNA WERKE HULS GMBH). In order to protect the elastic intermediate element against tearing off from the rope clamp and/or the lower clamping plate, it is advantageous to incorporate additionally a suitable reinforcement, for example, in the form of a helical wire strand.

The firm intermediate element can consist of the same material as the elastic element, but the decisive point is that the already above-mentioned non-displaceable connection to the adjacent rope clamps 15 is established, in accordance with FIG. 2. Moreover, the firm intermediate element can, of course, also be made of metals, such as for example aluminum and steel or another weather-stable and sufficiently load-bearing material. In the illustrated embodiment, the firm intermediate elements are made from BUNA AP.

As illustrated in FIGS. 1, 2 and 3A, the inventive assemblies may be provided with suitable spacer means such as spacer rings 13 for providing suitable spacing between the connector panels and the cable clamp or attaching means employed to hold the connector panels in place. In the illustrated embodiment, the spacer rings are made of BUNA AP although they can be made from any suitable material such as aluminum or steel.

The connector panel according to FIGS. 3A, 3B and 3C, consisting of a lower clamping plate 31, an upper clamping plate 32, a filling panel 33 and bearing profile members 34, is connected to ther intermediate element 11 by way of a clamping screw 37, which is coaxial with clamping screw 12 in the illustrated embodiment. The clamping screw is suitably mounted so that it seizes the lower clamping plate and is accessible through an appropriate opening in the upper clamping plate and the filling panel. The upper and lower clamping plates are joined by means of screws 14.

The configuration and dimensions of the connector panel are dependent on the given characteristics of the network to be covered and are illustrated as an example in FIG. 3. Thus, for instance, the two clamping plates can be fashioned to be symmetrical or asymmetrical or even with additional reinforcing ribs 35, 35. Besides, the clamping plates can consist, according to FIG. 4, for example of two individual panels joined to each other, for example, by tacking, stapling, gluing, riveting, or welding. This embodiment is particularly advantageous when the clamping plates are made from sheet metal. In this case, one part 41 of the clamping plate as shown in FIG. 4 can be deep-drawn or pressed with the optionally necessary reinforcing ribs being embossed therein; and the other part 42 can be shaped so that it encompasses substantially completely the filling panel and bearing profile members when the members are assembled together.

In addition to sheet metal, other materials suitable for the production of the clamping plates are, for example, reinforced synthetic resins reinforced with glass fibers and other materials such as for example glass-fiber-reinforced polyesters (GFP) or cast steel. Also forged connector panels can be utilized. When using, for example, reinforced synthetic resins, the clamping plates can be manufactured, for example, on a profile-drawing machine true to shape and can be provided at the same time with the reinforcing ribs. In the illustrated embodiment, the clamping plates are rigid and made from GFP manufactured by CHEMISCHE WERKE HUELS AG of Marl, Germany.

As indicated above, it is possible to utilize, in place of individual connector panels, also continuous connector strips according to FIGS. 5A and 5B, for constructional reasons. The description set forth hereinabove in connection with connector panels also applies analogously in connection with connector strips.

The filling panel 33 (FIG. 3A) serving for regulating the distance of the clamping plates always extends over the entire length of the connector panel. If a connector strip is employed, this filling panel is correspondingly fashioned as a filling strip. Suitable materials for the manufacture of the filling panels and/or strips are preferably vulcanized elastomers which are stable with respect to aging and weathering, such as, for example, butyl rubber, polychloroprene and quite particularly unsaturated ethylene-propylene rubber. In the illustrated embodiment, the filling panels and strips are made from BUNA AP manufactured by BUNA WERKE HUELS GMBH.

The bearing profile members 34 preferably also consist of the elastomers suitable for the production of the filling panels and in the illustrated embodiment the bearing profile members are made from BUNA AP manufactured by BUNA WERKE HUELS GMBH. The shape of these profile members is preferably cylindrical The bearing profile members can have the length of the connector panel or alternately can extend continuously around the edges of the covering panels held by the connector panels. In order to receive the edges of the covering panels, a groove shaped to conform to these edges is required which, if possible, can be provided either during the extrusion of the bearing profile members or by subsequent milling.

The embodiment of a cylindrical bearing profile member with a circular cross section and a linear groove is shown in FIGS. 6A and 6B. In these figures, 51 indicates an optional reinforcing insert, such as, for example, of steel sheeting, cord fabric, wire mesh, etc., while 52 shows an additional screw connection made with the edge-reinforced covering panel, and 53 shows recesses to receive the edge-reinforced covering panel which will be described in greater detail below. In the illustrated embodiment reinforcing insert 51 is made from cord fabric.

FIGS. 7A and 7B show a bearing profile member 34 with a wavy groove, as is required, for example, to receive a corrugated covering panel 38'. A bearing profile need not absolutely be of one piece, but rather can also consist of two or more parts, if this makes the manufacture or mounting of the groove and other recesses more advantageous and/or more economical. In this regard, see elements 61 and 62 in FIG. 7B.

Figure 8A:
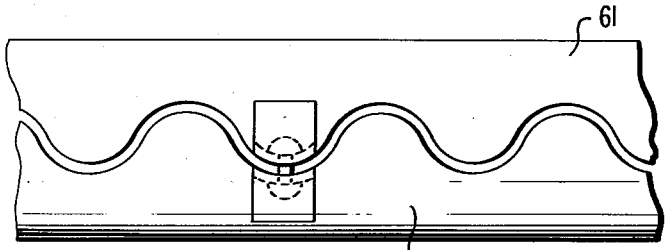
FIGS 8A, 8B and 8C are elevational, top and end views, respectively, illustrating how the composite bearing profile member of FIGS. 7A and 7B can be assembled together.
Figure 8B:
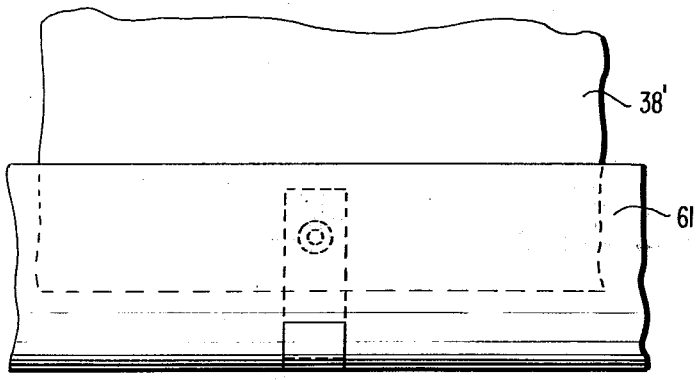
Figure 8C:
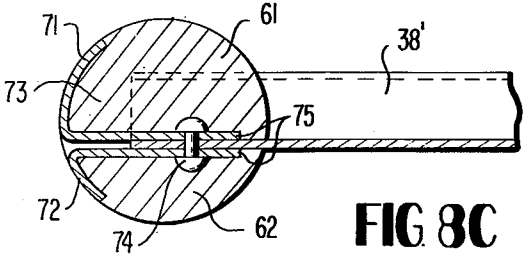

FIGS. 8A, 8B and 8C illustrate a possible way of mounting covering panel 38' with the bearing profile member 34'. In particular, as shown in these figures, vulcanized rubber material 73 of the bearing profile members is formed around mounting reinforcements 71 and 72. Upper and lower bearing profile members 61 and 62 are secured together by means of upper and lower clamping plates 31 and 32 as shown in FIG. 1 or screw connection 52 as shown in FIG. 6A.

As the covering panels for the assembly of the present invention, basically suitable are panels which have a load-bearing capacity over the desired span width and which furthermore are stable to weathering. Primarily suitable materials are metals, preferably aluminum, and plastics, such as, for example, impact-resistant PVC and glass-fiber-reinforced plastics. The covering panels can consist of one layer or can also be laminates or coated articles consisting of a plurality of layers. Furthermore, all existing profile configurations are possible. In the illustrated embodiment the curved panel is preferably constructed from PVC and the corrugated panel is preferably constructed from glass-fiber-reinforced plastic.

Figure 9:
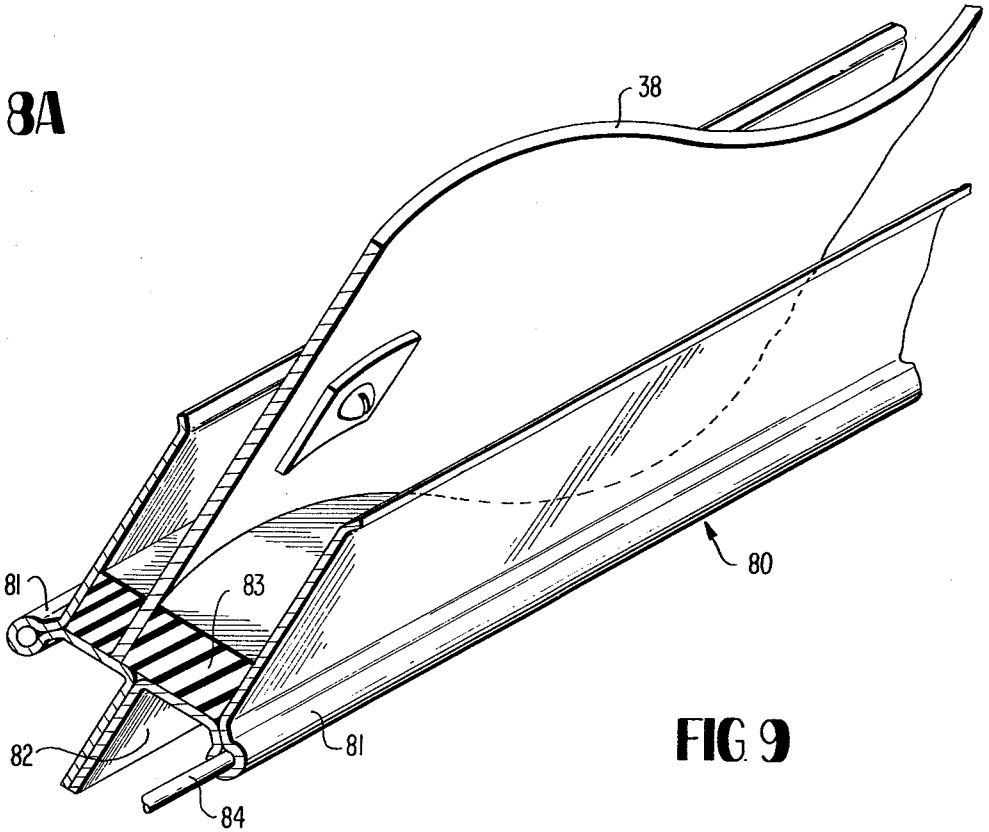
FIG. 9 illustrates an edge reinforcement for a corrugated covering panel which is employed to securely mount a bearing profile member on the covering panel.

With the use of such corrugated panels, it is advantageous to reinforce the edges held in the bearing profile members. A possible form of such reinforcement is shown in FIG. 9 at 80. This reinforcement is advantageously manufactured from sheet metal and joined by a spot connection or an area-type connection to the covering panels, e.g. by tacking, stapling, riveting, screwing or welding.

The edge reinforcement can also exhibit borders, as shown at 81, which hook into the recesses 53 of the bearing profile members. These borders can also receive a reinforcing insert, e.g. in the form of a wire 84. In addition, the edge reinforcement can also define a suitable extension 82 on its backside. Such extensions are advantageous when it is desirable to ensure that the edge-reinforced covering panels do not separate or slide away from the bearing profile members since these extensions are if appropriately designed penetrated by the screw connections 52, as shown in FIG. 6A.

An optional additional inner seal of the edge reinforcement is shown at 83. Preferably, such inner seals are made from the elastomers described above to form e.g., the bearing profile members 34 in FIGS. 1 or 3A.

In general, one connector panel holds four covering panels at their corners. It is futhermore desirable to cover the area not covered by the covering panels between two connector panels by means of an additional sealing plate 91, preferably made from a metal such as aluminum or stainless steel, or a synthetic resin, such as PVC or GFP. In the embodiment illustrated in FIG. 10, the sealing plates are made from GFP.

The sealing plates can have the shape of the cross section of the upper or lower clamping plates and are held by the latter, as shown in FIG. 10 by clamping and screw connections 92. The screw connection 92 also prevents the covering panels from sliding. The bearing profile members, the filling panel, and optionally the clamping plates can be provided with recesses to accomodate the thickness of the sealing plate 91 so that the assembly can be uniformly clamped together. In case connector strips are employed, these sealing plates are unnecessary, since there are not uncovered surface areas.

Figure 11:
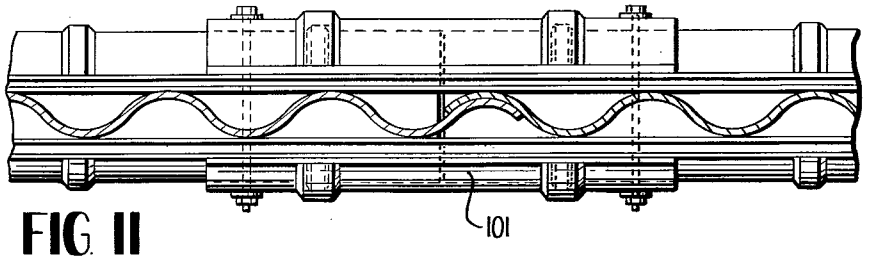
FIGS. 11 and 12 illustrate how adjacent connector strips are secured to one another when connector strips as opposed to connector panels are employed in the assembly of FIG. 1.
Figure 12:
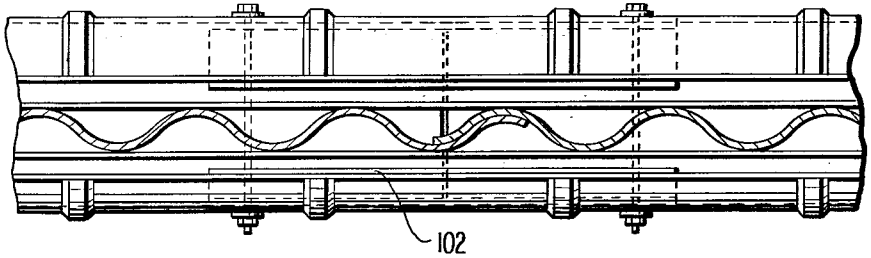
Figure 13B:
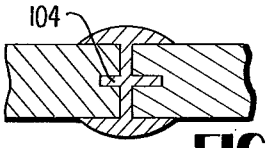
FIGS. 13A, 13B, 13C and 13D illustrate alternate methods for joining adjacent covering panels employed in the assembly of FIG. 1.
Figure 13D:
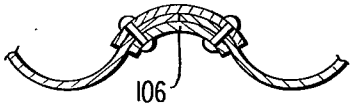
Figure 13A:
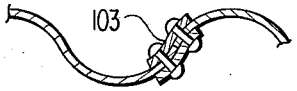
Figure 13C:
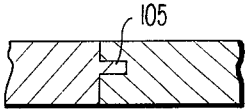

The joint configuration of the connector strips is shown in FIGS. 11 and 12. In this arrangement, overlapping junction panels 101 or joint panels pushed underneath the structure and denoted by 102 can be utilized. Possible joint configurations of the covering panels are shown in FIGS. 13A, 13B, 13C and 13D at 103, 104, 105 and 106, respectively.

The foregoing description has been presented for illustrative purposes only and is not intended to limit the invention in any way. All reasonable modifications not specifically set forth are intended to be included within the scope of the present invention which is to be limited only by the following claims.

What is claimed is:

1. Assembly for sheathing a network thereby forming a structure having generally curved surfaces comprising:

a. a connector panel or strip adapted to be joined to the network via a firm or elastic intermediate element, said connector panel or strip comprising at least two associated clamping plates and a filling panel therebetween to regulate the distance between the individual clamping plates or strips, said connector panel or strip holding two bearing profile members of a weather-resistant and aging-resistant vulcanized elastomer, and b. a covering panel attached to at least one of the bearing profile members held by the connector panel or strip, said covering panel being shaped to fit said network.

2. The assembly according to claim 1, wherein the connector panels or strips are made from glass-fiber-reinforced polyester, wherein the filling panels and the bearing profile members are made from vulcanized unsaturated ethylene-propylene rubber, and wherein said covering panels are made from impact-resistant polyvinyl chloride.

3. The assembly of claim 1 further including fastening means for holding said two clamping plates together whereby said covering panel is elastically retained by said connector panel.

4. The assembly of claim 1, wherein said two clamping plates define when assembled together cylindrical spaces, said bearing profile members being cylindrical in shape and maintained in said cylindrical spaces such that said bearing profile members are capable of rotating in said spaces.

5. The assembly according to claim 1, wherein said covering panel is reinforced at its edges.

6. The assembly according to claim 1, further including sealing panels for covering the edges of certain covering panels.

7. An assembly for lining a framework thereby forming a structure having generally curved surfaces comprising a plurality of connector panel assemblies adapted to be joined to the framework, each connector panel assembly comprising an intermediate element, attaching means for attaching the intermediate element to the framework, two associated clamping plates defining when assembled together retaining means and a filling panel between the associated clamping plates to regulate the distance therebetween; said assembly further including at least one covering panel shaped to fit said framework bearing profile means securely attached to at least a portion of the edges of said at least one covering panel, the bearing profile means being made from a weather-resistant and aging-resistant vulcanized elastomer; the retaining means on at least two different connector panels securely holding the bearing profile means attached to said at least one covering panel whereby said at least one covering panel is held in place on said framework.

8. The assembly according to claim 7, wherein said framework is a cable network composed of a plurality of intersecting cables which define openings therebetween, wherein said connector panel assemblies are attached to the cable network at respective points where the cables intersect and wherein some of the intermediate elements are rigid and other of said intermediate elements are elastic, said assembly further comprising a plurality of covering panels, each covering panel sized and shaped to fit over one of the openings defined by the cable network, each covering panel held in place on the cable network by at least two connector panel assemblies.

9. The assembly according to claim 8, wherein the cables in at least a portion of the cable network are orthagonally oriented, wherein the covering panels adapted to fit over the openings in said portion of the cable network are substantially rectangular in configuration, and wherein each of the rectangular covering panels are held by four connector panel assemblies, one connector panel at each corner of the rectangular covering panel.

10. The assembly according to claim 8, wherein said connector panel assemblies hold at least two covering panels in such a way that a space is defined between the two covering panels, said assembly further including at least one sealing panel to cover said space.

11. The assembly according to claim 7, wherein at least some of said intermediate elements are made from elastomers.

12. The apparatus according to claim 11, wherein said elastomers are weather-resistant, age-resistant and selected from the group consisting of butyl rubber, polychloroprene, and unsaturated ethylene-propylene rubber.

13. The assembly according to claim 12, wherein the elastic intermediate element is reinforced with a helical strand.

14. The assembly according to claim 8, wherein said bearing profile means comprises a single bearing profile memeber.

15. The assembly according to claim 8, wherein said bearing profile means comprises at least two bearing profile members, one bearing profile member associated with each connector panel assembly attached to said at least one covering panel.

16. The assembly according to claim 7, further including spacer means for spacing said attaching means from said intermediate element.

17. The assembly according to claim 7, wherein said clamping plates are rigid.

* * * * *